US009551188B1

(12) United States Patent
Christy et al.

(10) Patent No.: US 9,551,188 B1
(45) Date of Patent: Jan. 24, 2017

(54) SPLIT TUBE SOIL SAMPLING SYSTEM

(71) Applicant: Kejr, Inc., Salina, KS (US)

(72) Inventors: Joel Christy, Brookville, KS (US); Kyle Riedel, Salina, KS (US)

(73) Assignee: Kejr Inc., Salina, KS (US)

( * ) Notice: Subject to any disclaimer, the term of this patent is extended or adjusted under 35 U.S.C. 154(b) by 356 days.

(21) Appl. No.: 14/208,939

(22) Filed: Mar. 13, 2014

Related U.S. Application Data

(60) Provisional application No. 61/780,100, filed on Mar. 13, 2013.

(51) Int. Cl.
*E21B 7/26* (2006.01)
*E21B 25/00* (2006.01)

(52) U.S. Cl.
CPC ..... *E21B 7/265* (2013.01); *E21B 25/00* (2013.01)

(58) Field of Classification Search
CPC ..... E21B 25/00; E21B 49/02; E21B 7/027; E21B 25/18; E21B 7/265; E21B 25/005; E21B 25/02; E21B 25/04; E21B 25/10; E21B 25/12; E21B 27/00; B09C 1/00
USPC ..... 175/20
See application file for complete search history.

(56) References Cited

U.S. PATENT DOCUMENTS

| | | | | |
|---|---|---|---|---|
| 3,092,192 | A * | 6/1963 | Deely | E21B 25/10 166/70 |
| 3,878,906 | A * | 4/1975 | Guest | E21B 7/26 175/20 |
| 6,095,259 | A * | 8/2000 | Keyes | E21B 17/04 175/20 |
| 6,695,075 | B2 | 2/2004 | Becker | |
| 7,182,155 | B2 | 2/2007 | Lange | |
| 7,347,281 | B2 * | 3/2008 | Zastresek | E21B 25/005 175/20 |
| 7,600,580 | B2 * | 10/2009 | Cravatte | E21B 25/08 166/264 |
| 2004/0079555 | A1 * | 4/2004 | Lange | E21B 7/24 175/320 |

* cited by examiner

*Primary Examiner* — Michael Wills, III
(74) *Attorney, Agent, or Firm* — Jeffrey L. Thompson; Thompson & Thompson, P.A.

(57) ABSTRACT

A split tube soil sampling system includes a sample tube having an upper end and a lower end, a drive head attached to the upper end of the sample tube, and a cutting shoe attached to the lower end of the sample tube. The sample tube has a first generally semi cylindrical tube segment comprising a first pair of longitudinal edges, and a second generally semi cylindrical tube segment comprising a second pair of longitudinal edges. The first and second tube segments are configured to be joined together along their respective longitudinal edges to form a cylinder having a through bore. The longitudinal edges of the tube segments have interlocking fingers that are mated together to hold the first and second tube segments together.

20 Claims, 5 Drawing Sheets

SPLIT TUBE SOIL SAMPLING SYSTEM

RELATED APPLICATIONS

This application claims the benefit of U.S. Provisional Patent Application No. 61/780,100 filed on Mar. 13, 2013. The entire content of the priority application is incorporated herein by reference.

BACKGROUND OF THE INVENTION

Field of the Invention

The present invention relates generally to devices for obtaining soil samples from below the surface of the ground. In particular, the present invention relates to split tube soil sampling systems.

Description of the Related Art

Methods and practices for collecting representative subsurface soil samples date back many decades. The collection of soil samples is a necessity in some of the following industries: environmental, geotechnical, mineral exploration, and agricultural.

The basic components of a conventional soil sampling assembly 10 are shown in a cutaway view in FIG. 1, and are briefly described below.

A soil sample tube/barrel 11 is typically a cylindrical tube with a threaded connection to a cutting shoe 12 on one end, and a drive head 13 on the other end. The sample tube or barrel 11 provides the space or container that the soil sample occupies once it is collected. It is noteworthy that the cutting shoe 12, sample tube 11, and drive head 13 are usually manufactured with mating threads so that the entire assembly can be threaded and unthreaded in the field.

The cutting shoe or bit 12 is a separate component with a cutting surface 14 at the leading edge of the sampler. The cutting shoe or bit 12 is the component responsible for cutting through the soil as the soil sampler assembly 10 is driven or advanced through the sample interval. It also protects the sample tube (sampler) 11 from being damaged during advancement through the soil sample interval. The cutting shoe or bit 12 is usually considered a consumable part due to the wear of the cutting edge or leading surface. Cutting shoes or bits 12 have several different configurations suited for driving through a variety of soils ranging from soft soils to very hard rock formations. The cutting surface can utilize many different features, such as sharp cutting edges, cutting teeth, carbide buttons, diamond cutters, and many others.

The drive head or sampler head 13 is a component of the overall soil sampler assembly 10 that allows the sampler to be used with various drill rods, probe rods, center rods, or wire line systems. It serves as an adapter so that a common rod or wire line can be used to lower, drive, and retract the sampler assembly. It is common for the head 13 to feature various features, such as check balls, vent holes, and water or air passages.

The soil sampler assembly can also include soil liners (inside the sample tube), solid point assemblies for driving through unneeded soil intervals, and core catchers or core baskets to retain loose soil samples inside the sampler.

The general use and operation procedure for the conventional soil sampling assembly 10 are illustrated in FIG. 2 and are described as follows:

Soil Sampler Assembly and Advancement into Subsurface (i.e. Soil Sample Collection).

The assembled soil sampler 10 can be connected to a common rod, pipe, or casing, and driven or advanced through the sampling interval (usually 1 meter to 60 inches, but can be shorter or longer), as shown in FIG. 2(*a*). The means for driving or advancing the soil sampler assembly 10 can be percussion, rotation, vibration, static push, or a combination thereof.

Soil Sampler Assembly Extraction from the Subsurface or Borehole

Once the soil sampler assembly 10 has been advanced through the sampling interval, the soil sample has been collected, and the soil sample is occupying the sample tube 11, the soil sampler assembly 10 can be retracted from the borehole B using the connected, drill rod, probe rod, or wire line. FIG. 2(*b*) shows the empty borehole B after the soil sampler assembly 10 has been retracted; FIG. 2(*c*) shows the sampler assembly 10 being reinserted into the borehole B after the first soil sample has been removed; and FIG. 2(*d*) shows the sampler assembly 10 being advanced through a second sampling interval below the first sampling interval.

Soil Sample Removal from the Soil Sampler Assembly

When the soil sampler assembly is retracted from the borehole to ground surface there are a number of methods for obtaining physical access to the actual soil sample inside the soil sampler assembly. The methods and practices for accessing the soil sample inside the soil sampler assembly range from careful and tedious to quickly and carelessly. The latter usually causing the most disruption and damage to the soil sample. It is considered good practice to minimize the disruption to the soil sample. Some of the methods and practices for gaining access to the soil sample inside the soil sampler are as follows:

Soil Liner

One common method to gain access to the soil sample relies on the use of a liner inside the soil sampler assembly (mentioned above). In this case, the liner simply slides out of the end of the sample tube once the cutting shoe or bit is removed. The liner can then be cut with a special cutter in order to gain physical access to the soil sample. While this method is advantageous due to its efficiency and cleanliness, it comes with a monetary cost (i.e., the cost of the liner), and can be limited to softer soils due to the amount of energy needed to collect samples in hard formations. In these cases, the liner can melt or collapse inside the sample tube, thus impeding access to the soil sample.

Vibratory Extraction

In some applications the soil sample is vibrated out of the sample tube using a vibratory oscillator (sonic). This method does not require a soil liner, and therefore eliminates the cost of the liner and allows soil samples to be collected in harder formations such as rock. However, this can cause significant disturbance to the soil sampler due to the violent nature of vibrating the soil out of the sample tube and re-collecting it in another containment item, such as a plastic bag or tray.

Hydraulic/Pneumatic Extraction

This practice is less common since it requires the use of compressed water or air to "urge" or pump the soil sample out of the soil sample tube. In some cases it is advantageous due to its speed, but it is usually avoided due to the high potential for disturbing and damaging the soil sample. An example of this method is outlined in U.S. Pat. No. 6,695,075.

Split Sample Tube/Barrel

This approach relies on the use of a drivable sample tube that can be opened up in order to gain access to the soil sample. It is advantageous since it minimizes disturbance to the soil sample, and it does not require the use of a soil liner (although soil liners can be used with split samplers). Split soil samplers have been on the market for a number of years, an example of which is disclosed in U.S. Pat. No. 7,182,155.

In FIGS. 1, 1A, 1B and 2 of U.S. Pat. No. 7,182,155, an industry standard split sampler is disclosed. It is common in the industry to refer to this design as a "split spoon," and its construction and method of use are outlined in an ASTM standard. The standard split sampler uses a basic "lap" to align the two sample tube halves, and also utilizes a standard drive head and cutting shoe. While this approach is considered an industry standard, it is limited by its significant decrease in strength when manufactured in longer lengths, such as 60 inches. It is usually manufactured in 24 inch lengths, which makes it very inefficient when many soil samples are needed. It is common to collect soil samples for over 50 continuous feet. This can be done more efficiently if longer (e.g., 60 inch) soil samples are collected.

U.S. Pat. No. 7,182,155 also disclosed a split tube design having a tongue and groove type feature to overcome weaknesses in longer lengths. The tongue and groove construction helps to prevent the sampler assembly from bulging out when driving in hard soils, which is a common problem associated with the "split spoon." It is not clear if this design is indeed an improvement over the "split spoon" design, but it does have some clear disadvantages. The use of a tongue and groove connection on a tubular component requires a very involved manufacturing process. The nature of this type of connection would likely be problematic when sampling in sandy soils where the sand would penetrate the tongue and groove joint and "sand lock" the two halves of the split sampler together.

There is a need in the industry for an improved split tube soil sampling system.

SUMMARY OF THE INVENTION

A split tube soil sampling system according to the present invention includes a drivable, split, soil sampler. It is primarily used for the collection of subsurface soil samples. The split design is a robust feature that facilitates efficient access to the soil sample with minimal disturbance to the soil sample once the soil sample is collected.

According to one aspect of the present invention, the split tube soil sampling system includes a sample tube having an upper end and a lower end, a drive head attached to the upper end of the sample tube, and a cutting shoe attached to the lower end of the sample tube. The sample tube has a first generally semi cylindrical tube segment comprising a first pair of longitudinal edges, and a second generally semi cylindrical tube segment comprising a second pair of longitudinal edges. The first and second tube segments are configured to be joined together along their respective longitudinal edges to form a cylinder having a through bore. The longitudinal edges of the tube segments have interlocking fingers that are mated together to hold the first and second tube segments together.

According to another aspect of the present invention, a soil sampling tube assembly for collecting soil samples is provided, comprising: a first generally semi cylindrical tube segment comprising a first pair of longitudinal edges; and a second generally semi cylindrical tube segment comprising a second pair of longitudinal edges. The first and second tube segments are configured to be joined together along their respective longitudinal edges to form a cylinder having a through bore. The longitudinal edges of the tube segments comprise interlocking fingers that are mated together to hold the first and second tube segments together.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A split tube soil sampling system 20 according to the present invention will now be described in detail with reference to FIGS. 3 to 7 of the accompanying drawings.

Figure 1:
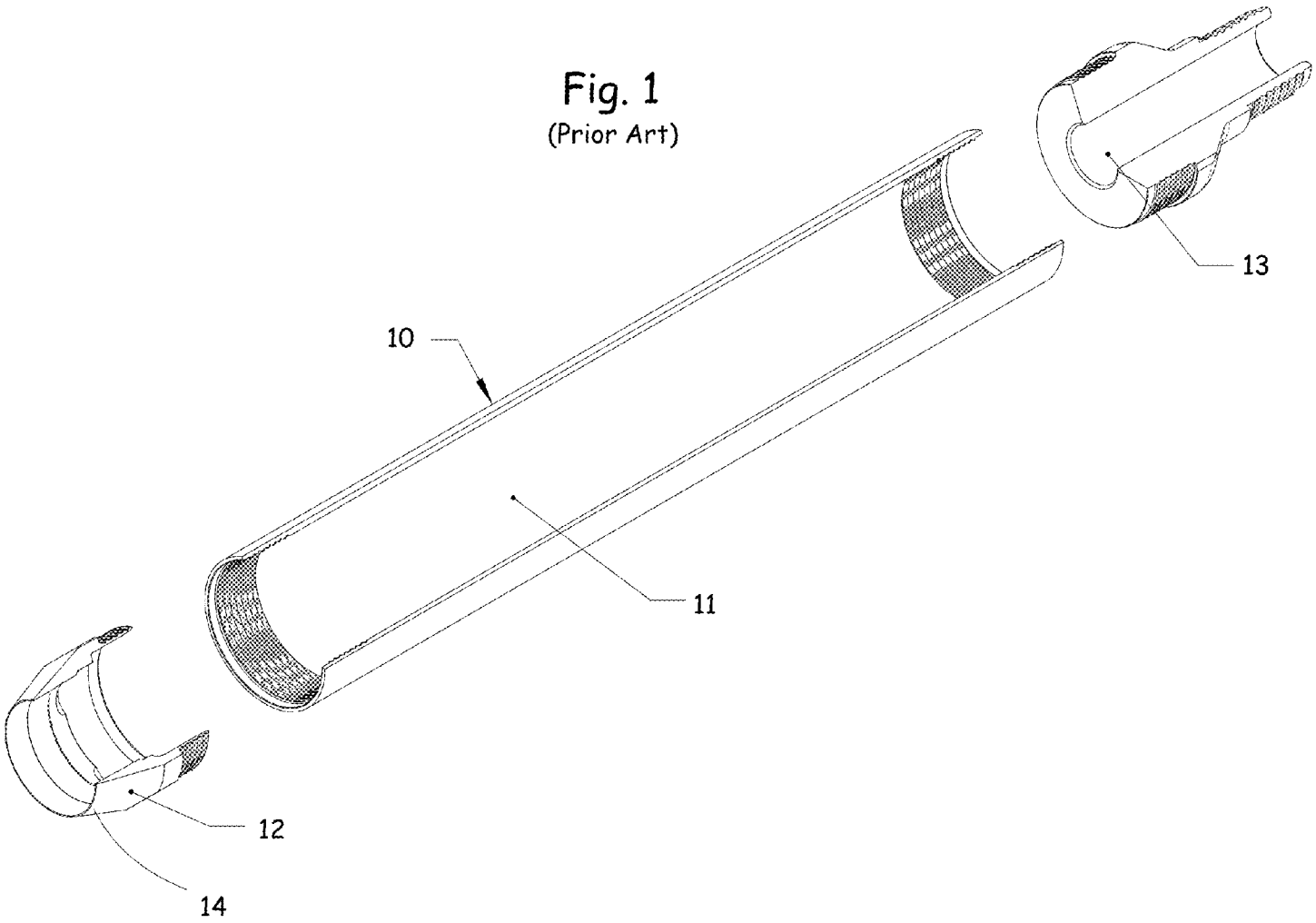
Fig. 1 (Prior Art)
FIG. 1 is a cutaway exploded perspective view of a conventional soil sampling system.
Figure 2:
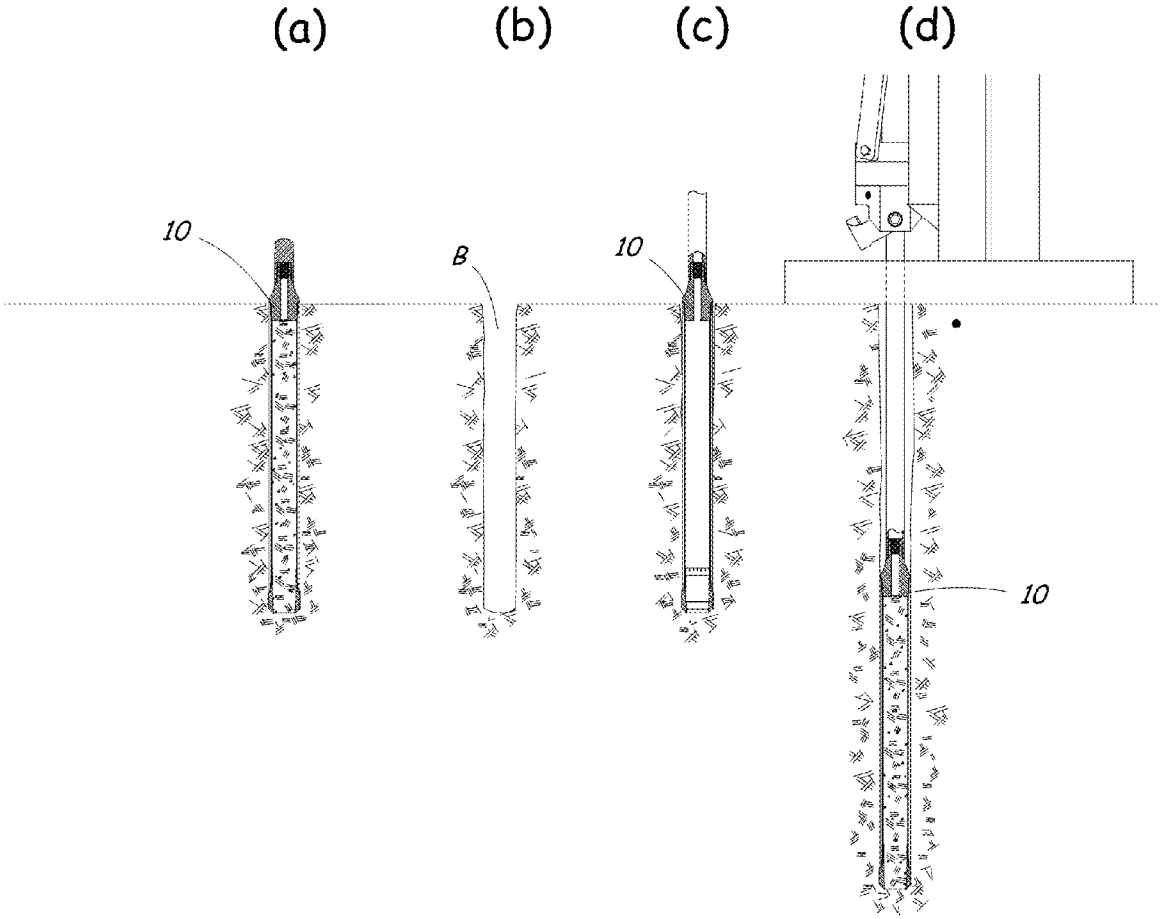
Fig. 2 (Prior Art)
FIG. 2 illustrates a typical soil sampling operation using the conventional soil sampling system shown in FIG. 1.
Figures 3, 4:
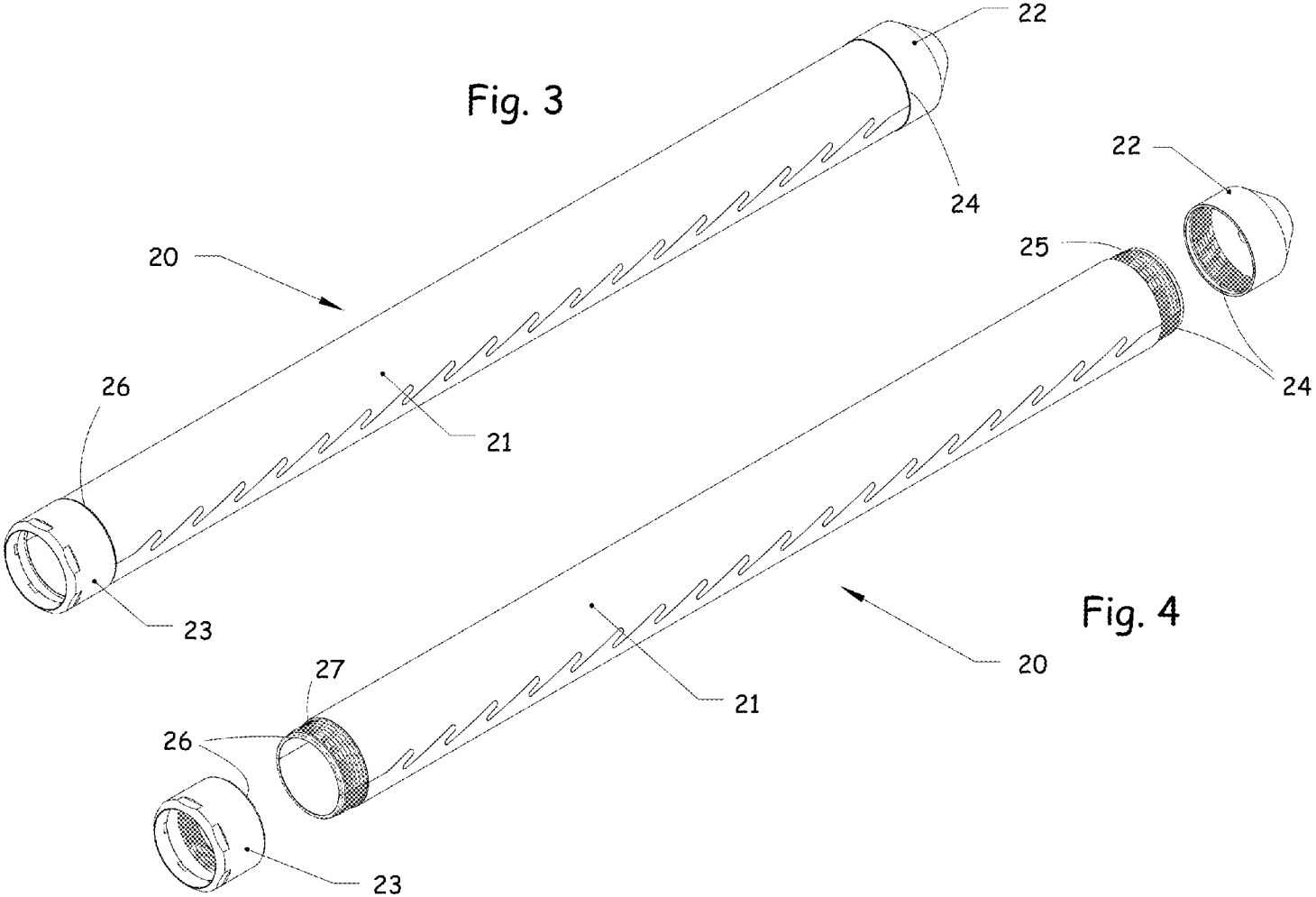
FIG. 3 is a perspective view of a split tube soil sampling system according to the present invention.
FIG. 4 is a perspective view of the split tube soil sampling system shown in FIG. 3, with the drive head and cutting shoe removed from the sample tube.
Figure 5:
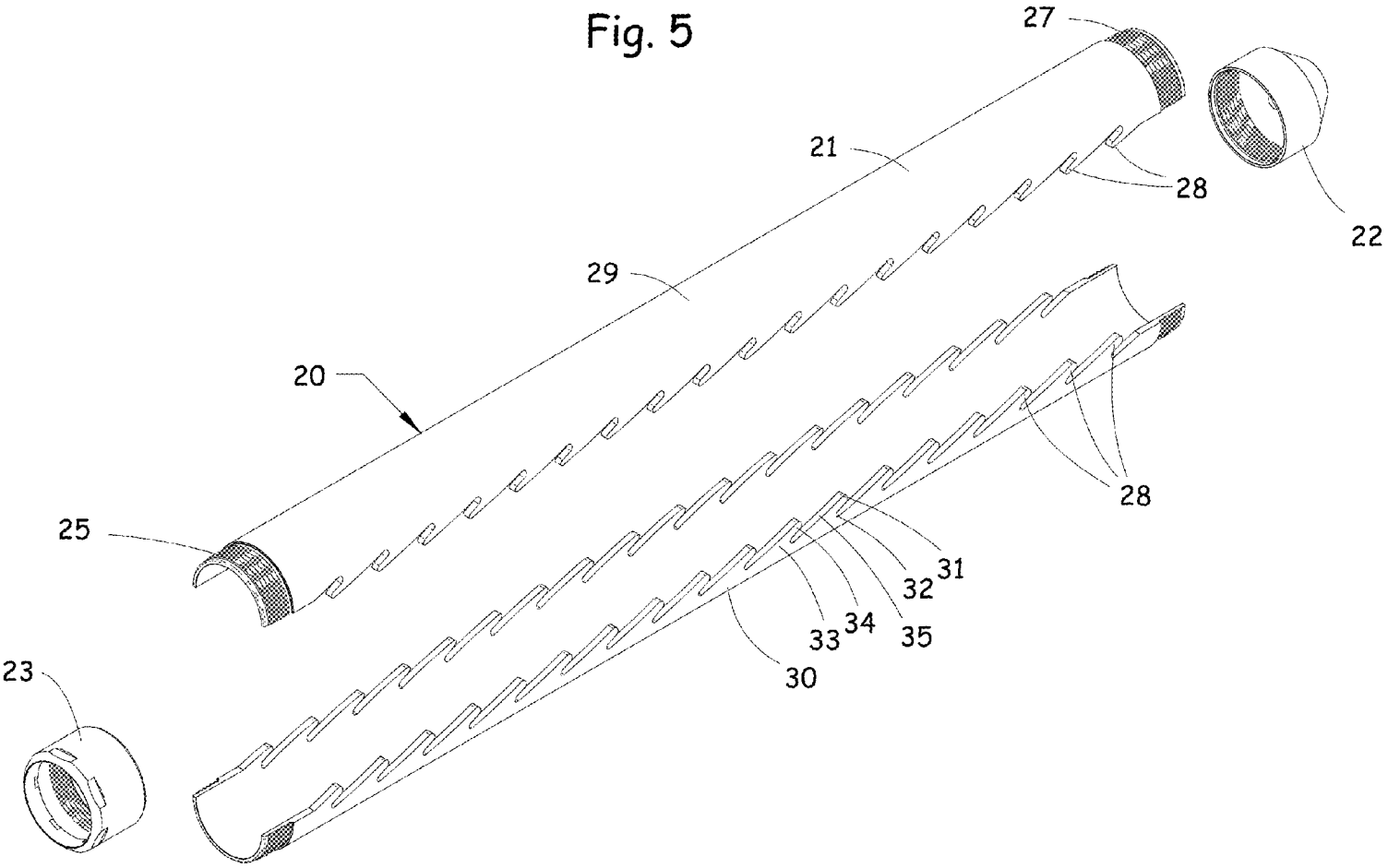
FIG. 5 is an exploded perspective view of the split tube soil sampling system shown in FIG. 4.

The basic components of the split tube soil sampling system 20 of the present invention are shown in FIGS. 3 and 4. The split tube sampling system 20 includes a sample tube 21, a drive head 22 attached to the upper end of the sample tube 21, and a drive shoe or cutting shoe 23 attached to the lower end of the sample tube 21. The sampling system 20 can be used in vibratory, percussion, and rotary applications. Other features such as soil liners, discreet points, and core catchers can also be used with the sampling system 20.

The soil sampling system 20 utilizes a split sample tube 21 to accommodate efficient access to the soil sample. The soil sampling system 20 has a first threaded coupling 24 between the upper end 25 of the sample tube 21 and the drive head 22, and a second threaded coupling 26 between the lower end 27 of the sample tube and the cutting shoe 23. The split sample tube 21 has male threads on both of its upper and lower ends 25, 27, and the drive head 22 and cutting shoe 23 both have female threads that mate with the male threads to form the first and second threaded couplings 24, 26. The first and second threaded couplings 24, 26, along with the interlocking fingers 28 (described below), hold the entire soil sampler assembly 20 together when in use.

The split sample tube 21 includes two generally semi cylindrical tube segments 29, 30 that are configured to be joined together along their respective longitudinal edges to form a cylinder having a through bore. The tube segments 29, 30 can be made by cutting a single tube longitudinally into two pieces along the profile of the interlocking fingers 28.

The longitudinal edges of the tube segments 29, 30 comprise interlocking fingers 28 that are mated together to hold the tube segments 29, 30 together. The interlocking fingers 28 are each disposed at a non-zero angle (e.g., 15 to 20 degrees) relative to the longitudinal direction of the sample tube 21 and are interlocked with each other to prevent the tube segments 29, 30 from separating laterally from each other. The interlocking fingers 28 are integral with the tube segments 29, 30 and define a portion of the cylindrical sidewall of the tube 21. The interlocking fingers 28 of one tube segment 29 overlap with the interlocking fingers 28 of the other tube segment 30 in a circumferential direction of the tube 21. That is, a circumferential line can be drawn around the sample tube 21 at each of the interfaces between the tube segments 29, 30 that intersects fingers 28 of both of the tube segments 29, 30.

In the illustrated embodiment, the interlocking fingers 28 are arranged in a wave pattern having overlapping crests 31 and troughs 32 along each of the longitudinal edges of the tube segments 29, 30. The troughs 32 are formed between the base ends 33 of adjacent fingers 28, and the crests 31 are formed by the free ends 34 of the fingers 28. The free ends 34 of the fingers 28 of one tube segment 29 are mated with and fit into the troughs 32 of the other tube segment 30, and vice versa. The free ends 34 of the fingers 28 and the troughs 32 are rounded to minimize stress concentrations.

A sloped surface 35 extends between the base end 33 and free end 34 of each finger 28 and is disposed at a nonzero angle relative to the longitudinal direction of the tube 21. The sloped surfaces 35 on the fingers 28 of one tube segment 29 engage corresponding sloped surfaces 35 on the fingers 28 of the other tube segment 30. The sloped surfaces 35 provide a means for forcing the tube segments 29, 30 laterally apart when the tube segments 29, 30 are slid longitudinally relative to each other.

In use, the soil sampler assembly 20 is advanced through the soil sample interval to collect the soil sample. The assembly 20 is then retracted out of the borehole and brought to the surface where it can be disassembled. Disassembly of the soil sampler assembly 20 requires the cutting shoe 23 and drive head 22 to be removed. The two sample tube segments 29, 30 are then slid longitudinally in opposite directions until the interlocking fingers 28 are no longer engaged with one another. The two sample tube segments 29, 30 are then separated so that the user has access to the soil sample. Once the soil sample has been evaluated, the sample tube segments 29, 30 are cleaned and reassembled for reuse.

Advantages Over Prior Art:

The split tube soil sampler 20 of the present invention provides several improvements over the prior art. For example, the interlocking fingers 28 create a very strong mechanism for joining the two sample tube segments 29, 30 together. The geometry of the interlocking fingers 28 also allows rounded edges to be used to minimize stress concentrations within the sample tube 21. This is significant because the sample tube 21 is subjected to high cycle loading which requires that stress concentrations (sharp corners, etc.) be minimized.

Figure 6:
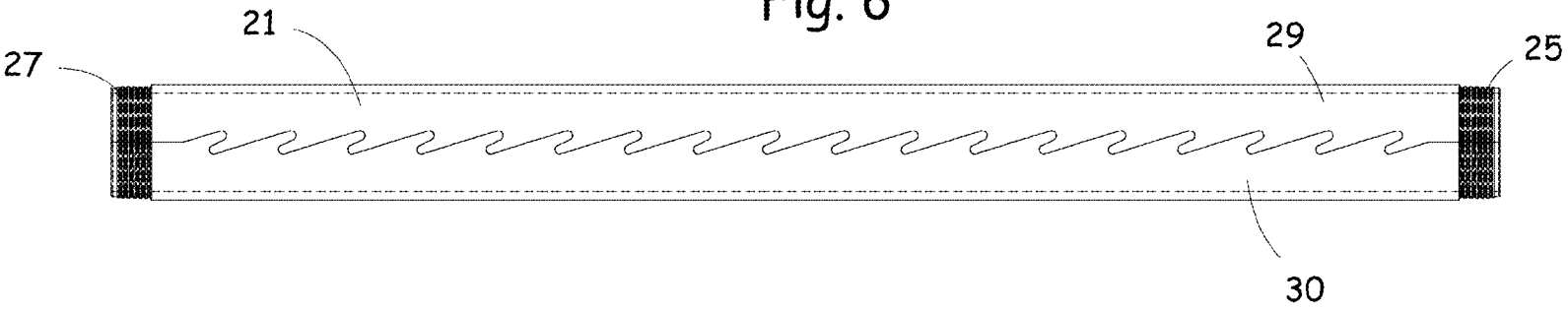
FIG. 6 is a side view of the split sample tube of the present invention, with the tube segments in their interlocked position.
Figure 7:
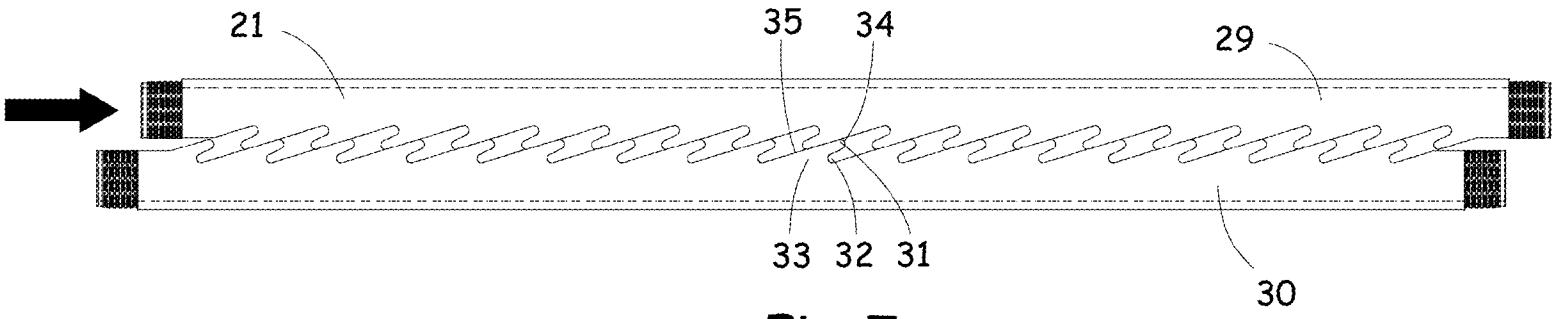
FIG. 7 is a side view of the split sample tube of the present invention as the tube segments are being slid longitudinally relative to each other to separate the tube segments.

As shown in FIGS. 6 and 7, the angle of the interlocking fingers 28 assists in the separation of the two sample tube segments 29, 30. During the disassembly process, one segment of the sample tube is held static, and the second segment is slid longitudinally in relation to the static segment. The angle of the interlocking fingers 28 forces the two sample tube segments 29, 30 apart in a lateral direction. This is very advantageous when sticky soils such as clay and silt are present inside the sample tube assembly 20.

A special tool can be fabricated to facilitate the disassembly process. The tool would hold one of the sample tube segments 29, 30 in place, and would use a linear actuator, such as a long screw, to apply a longitudinal force to the other sample tube segment 29, 30. The linear actuator would force the two sample tube segments 29, 30 to separate from each other.

The entire sample tube 21 (both tube segments) can be manufactured from a single length of steel tube. In contrast, the prior art designs for split tube samplers require two separate lengths of tube to manufacture the complete assembly.

The entire sample tube 21 is heat treated end-to-end for increased strength. The current design utilizes a grade of steel tube that is completely through-hardened and tempered.

The interlocking finger arrangement is more tolerant to being assembled with some soil or debris present within the interface between the two tube segments. Features in the prior art require this interface to be completely free of debris and soil for proper assembly.

The design of the interlocking fingers facilities the longitudinal alignment of the two sample tube segments 29, 30, which is necessary for final assembly of the cutting shoe 23 and drive head 22 to the tube 21.

It will be appreciated that certain features of the present invention described above can be changed without departing from the scope of the invention. For example, the sample tube can be made to have interlocking fingers located at spaced intervals along its length, or it can have clusters of interlocking fingers located at spaced intervals along its length. The split sampler may be applied to different diameters and lengths of soil sampler assemblies. The number and orientation of the interlocking fingers may be altered to suit different applications and soil conditions. The split sampler may be used as a standalone soil sampler, as well as with dual tube sampling systems. The split sampler may be adapted for use with different drill rigs, probe machines, and other advancement methods.

A tool with a linear actuator, such as a screw mechanism, or other type of powered actuator for separating the sample tube segments may be automated to speed up the process.

Soil sample liners may be incorporated into the split sampler assembly in order to speed up the process of decontaminating the sample tube segments.

While the invention has been specifically described in connection with specific embodiments thereof, it is to be understood that this is by way of illustration and not of limitation, and the scope of the appended claims should be construed as broadly as the prior art will permit.

What is claimed is:

1. A split tube soil sampling system, comprising:

a sample tube having an upper end and a lower end;

a drive head attached to the upper end of said sample tube;

a cutting shoe attached to the lower end of said sample tube;

said sample tube comprising a first generally semi cylindrical tube segment comprising a first pair of longitudinal edges, and a second generally semi cylindrical tube segment comprising a second pair of longitudinal edges, said first and second tube segments being configured to be joined together along their respective longitudinal edges to form a cylinder having a through bore, said longitudinal edges of said tube segments comprising interlocking fingers that are mated together to hold the first and second tube segments together;

wherein each of said interlocking fingers extends at a non-zero angle relative to a longitudinal direction of said sample tube, said fingers each include a first end that defines a trough, a second end that defines a crest, and a sloped surface extending between said first and second ends that engages a corresponding sloped surface on the other tube segment to provide a means for forcing the tube segments laterally apart when the tube segments are slid longitudinally relative to each other.

2. The split tube soil sampling system according to claim 1, wherein said tube segments of said sample tube are further held together by a first threaded coupling between said upper end of the sample tube and said drive head, and a second threaded coupling between said lower end of the sample tube and said cutting shoe.

3. The split tube soil sampling system according to claim 2, wherein said upper end of the sample tube comprises male threads that are mated with female threads of said drive head to form said first threaded coupling, and said lower end of the sample tube comprises male threads that are mated with female threads of said cutting shoe to form said second threaded coupling.

4. The split tube soil sampling system according to claim 1, wherein a plurality of said interlocking fingers are located on each of said longitudinal edges of said tube segments.

5. The split tube soil sampling system according to claim 4, wherein said interlocking fingers are arranged in a wave pattern of overlapping crests and troughs along each of said longitudinal edges.

6. The split tube soil sampling system according to claim 1, wherein said interlocking fingers are integral with said tube segments and define a portion of a sidewall of said cylinder.

7. The split tube soil sampling system according to claim 1, wherein said interlocking fingers on said first tube segment overlap with said interlocking fingers on said second tube segment in a circumferential direction of said cylinder such that the fingers of one of the tube segments are received in the troughs of the other tube segment and vice versa.

8. The split tube soil sampling system according to claim 1, wherein said second ends of said interlocking fingers are rounded to minimize stress concentrations.

9. The split tube soil sampling system according to claim 1, wherein said troughs are rounded to minimize stress concentrations.

10. A split tube soil sampling system, comprising:

a sample tube having an upper end and a lower end;

a drive head attached to the upper end of said sample tube;

a cutting shoe attached to the lower end of said sample tube;

said sample tube comprising a first generally semi cylindrical tube segment comprising a first pair of longitudinal edges, and a second generally semi cylindrical tube segment comprising a second pair of longitudinal edges, said first and second tube segments being configured to be joined together along their respective longitudinal edges to form a cylinder having a through bore, said longitudinal edges of said tube segments comprising interlocking fingers that are mated together to hold the first and second tube segments together;

wherein a plurality of said interlocking fingers are located on each of said longitudinal edges of said tube segments;

wherein said interlocking fingers are arranged in a wave pattern of overlapping crests and troughs along each of said longitudinal edges; and wherein each of said interlocking fingers has a first end that defines a trough, a second end that defines a crest, and a sloped surface extending between said first and second ends that engages a corresponding sloped surface on the other tube segment to provide a means for forcing the tube segments laterally apart when the tube segments are slid longitudinally relative to each other.

11. A soil sampling tube assembly for collecting soil samples, comprising:

a first generally semi cylindrical tube segment comprising a first pair of longitudinal edges;

a second generally semi cylindrical tube segment comprising a second pair of longitudinal edges;

said first and second tube segments being configured to be joined together along their respective longitudinal edges to form a cylinder having a through bore, said longitudinal edges of said tube segments comprising interlocking fingers that are mated together to hold the first and second tube segments together;

wherein each of said interlocking fingers has a first end that defines a trough, a second end that defines a crest, and a sloped surface extending between said first and second ends that engages a corresponding sloped surface on the other tube segment to provide a means for forcing the tube segments laterally apart when the tube segments are slid longitudinally relative to each other.

12. The soil sampling tube assembly according to claim 11, wherein said tube segments comprise male threaded upper ends for forming a first threaded coupling with a drive head, and male threaded lower ends for forming a second threaded coupling with a cutting shoe.

13. The soil sampling tube assembly according to claim 11, wherein said interlocking fingers are each disposed at a non-zero angle relative to a longitudinal direction of said cylinder, whereby said fingers assist in separating the tube segments when the tube segments are slid longitudinally relative to each other.

14. The soil sampling tube assembly according to claim 11, wherein a plurality of said interlocking fingers are located on each of said longitudinal edges of said tube segments.

15. The soil sampling tube assembly according to claim 14, wherein said interlocking fingers are arranged in a wave pattern of overlapping crests and troughs along each of said longitudinal edges.

16. The soil sampling tube assembly according to claim 11, wherein said interlocking fingers are integral with said tube segments and define a portion of a sidewall of said cylinder.

17. A soil sampling tube assembly for collecting soil samples, comprising:

a first generally semi cylindrical tube segment comprising a first pair of longitudinal edges;

a second generally semi cylindrical tube segment comprising a second pair of longitudinal edges;

said first and second tube segments being configured to be joined together along their respective longitudinal edges to form a cylinder having a through bore, said longitudinal edges of said tube segments comprising interlocking fingers that are mated together to hold the first and second tube segments together;

wherein each of said interlocking fingers extends at a non-zero angle relative to a longitudinal direction of said sample tube, said fingers each include a first end that defines a trough, a second end that defines a crest, and a sloped surface extending between said first and second ends that engages a corresponding sloped surface on the other tube segment to provide a means for forcing the tube segments laterally apart when the tube segments are slid longitudinally relative to each other.

18. The soil sampling tube assembly according to claim 17, wherein said interlocking fingers on said first tube segment overlap with said interlocking fingers on said second tube segment in a circumferential direction of said cylinder such that the fingers of one of the tube segments are received in the troughs of the other tube segment and vice versa.

19. The soil sampling tube assembly according to claim 17, wherein said second ends of said interlocking fingers are rounded to minimize stress concentrations.

20. The soil sampling tube assembly according to claim 17, wherein said troughs are rounded to minimize stress concentrations.

* * * * *